US009339866B2

(12) United States Patent
Kato et al.

(10) Patent No.: US 9,339,866 B2
(45) Date of Patent: May 17, 2016

(54) CORE SAND FILLING METHOD

(71) Applicant: SINTOKOGIO, LTD., Nagoya-shi, Aichi (JP)

(72) Inventors: Shigeyoshi Kato, Toyokawa (JP); Hisashi Harada, Toyokawa (JP)

(73) Assignee: SINTOKOGIO, LTD., Nagoya-shi, Aichi (JP)

( * ) Notice: Subject to any disclaimer, the term of this patent is extended or adjusted under 35 U.S.C. 154(b) by 0 days.

(21) Appl. No.: 14/402,753

(22) PCT Filed: Feb. 7, 2013

(86) PCT No.: PCT/JP2013/052931
§ 371 (c)(1),
(2) Date: Nov. 21, 2014

(87) PCT Pub. No.: WO2013/175814
PCT Pub. Date: Nov. 28, 2013

(65) Prior Publication Data

US 2015/0144289 A1 May 28, 2015

(30) Foreign Application Priority Data

May 25, 2012 (JP) ..... 2012-119357

(51) Int. Cl.

| | |
|---|---|
| ***B22C 9/10*** | (2006.01) |
| ***B22C 13/16*** | (2006.01) |
| ***B22C 15/24*** | (2006.01) |
| ***B22C 13/12*** | (2006.01) |
| ***B22C 19/04*** | (2006.01) |

(52) U.S. Cl.
CPC . *B22C 9/10* (2013.01); *B22C 13/12* (2013.01); *B22C 13/16* (2013.01); *B22C 15/24* (2013.01); *B22C 19/04* (2013.01)

(58) Field of Classification Search
CPC ..... B22C 9/10; B22C 13/16; B22C 19/04; B22C 13/12; B22C 15/23; B22C 15/24
See application file for complete search history.

(56) References Cited

FOREIGN PATENT DOCUMENTS

| | | | |
|---|---|---|---|
| CN | 2506375 | Y | 8/2002 |
| CN | 2701552 | Y | 5/2005 |
| CN | 1968771 | A | 5/2007 |
| CN | 201249253 | Y | 6/2009 |
| CN | 101862816 | | 10/2010 |
| CN | 101954459 | | 1/2011 |

(Continued)

OTHER PUBLICATIONS

U.S. Appl. No. 14/123,329, Sintokogio Ltd.

(Continued)

*Primary Examiner* — Kevin P Kerns
*Assistant Examiner* — Steven Ha
(74) *Attorney, Agent, or Firm* — Drinker Biddle & Reath LLP

(57) ABSTRACT

The core sand filling method comprises a step of operating an aeration air supply means, so as to float and fluidize core sand within a sand blow chamber and, when a pressure Pf of the sand blow chamber measured by the first pressure sensor reaches a first pressure, operating a compressed air supply means and a step of stopping the aeration air supply means and compressed air supply means from operating when each of the pressure Pf within the sand blow chamber and a pressure Pc within a sand storage chamber is a second pressure or higher while a differential pressure ΔP=Pc−Pf is a third pressure or lower.

18 Claims, 6 Drawing Sheets

(56) References Cited

FOREIGN PATENT DOCUMENTS

| | | | |
|---|---|---|---|
| CN | 103492104 | | 1/2014 |
| JP | S31-004119 | | 3/1956 |
| JP | S31-6413 | B | 7/1956 |
| JP | S47-13179 | B | 4/1972 |
| JP | S47-41368 | Y1 | 12/1972 |
| JP | S56-84155 | A | 7/1981 |
| JP | S59-041821 | | 10/1984 |
| JP | S60-113146 | U | 7/1985 |
| JP | S61-202747 | A | 9/1986 |
| JP | H05-305386 | A | 11/1993 |
| JP | H10-166106 | A | 6/1998 |
| JP | H10-216902 | | 8/1998 |
| JP | 2001-198653 | | 7/2001 |
| JP | 2008-213036 | A | 9/2008 |
| JP | 2008-264867 | A | 11/2008 |
| JP | 2009-183984 | A | 8/2009 |
| WO | WO 2008/120559 | | 10/2008 |
| WO | WO-2012/165056 | A2 | 12/2012 |
| WO | WO-2012/165181 | A1 | 12/2012 |

OTHER PUBLICATIONS

U.S. Appl. No. 14/381,683, Sintokogio Ltd.

CORE SAND FILLING METHOD

TECHNICAL FIELD

The present invention relates to a core sand filling method for filling a core box with core sand in a core molding machine.

BACKGROUND ART

A so-called top-blow type core molding machine in which a blow head is arranged above a core box so as to blow core sand down into the core box from thereabove has conventionally been used (e.g., Patent Literature 1). Since the blow head is arranged above the core box, and a core sand hopper is further arranged thereabove, the top-blow type core molding machine increases its height and becomes bulky.

CITATION LIST

Patent Literature

Patent Literature 1: Japanese Patent Publication No. S47-013179

SUMMARY OF INVENTION

Technical Problem

For reducing the size of a machine by making its profile as low as possible, a so-called under-blow type core molding machine in which a blow head is arranged under a core box so as to blow core sand up into the core box from thereunder may be used.

It is an object of the present invention to provide a core sand filling method which, when employing the under-blow scheme for blowing core sand up into a core box located on the upper side from thereunder, can favorably fill the core box with the core sand, thereby contributing to improving the efficiency in manufacturing cores.

Solution to Problem

Meanwhile, for filling the core box with core sand, a step of introducing an aeration air into the blow head arranged under the core box, so as to sufficiently float and fluidize the core sand, and a step of introducing a compressed air into the blow head, so as to blow the core sand into a cavity of the core box located above the blow head, are performed in the under-blow type core molding machine. However, the inventors conducted diligent studies and, as a result, have found that the core box may not favorably be filled with core sand depending on the state of air supply into the blow head. For example, such filling failures as parts with a low core sand packing density in the manufactured core and wrinkles on the surface of the manufactured core may occur. Therefore, the inventors have further conducted studies and, while taking account of the pressure within the blow head, have found that the core box can favorably be filled with core sand by controlling the air supply according to the pressure.

That is, the core sand filling method in accordance with one aspect of the present invention is a core sand filling method for filling a cavity of a core box with core sand from a blow head having a sand blow chamber and a sand storage chamber, the method comprising a first step of supplying an aeration air into the sand blow chamber by aeration air supply means in a state where the blow head and the core box communicate with each other while the blow head is located under the core box, so as to float and fluidize the core sand within the sand blow chamber; a second step of supplying as compressed air into the sand storage chamber by compressed air supply means according to an instruction from a control unit when a pressure within the sand blow chamber reaches a first pressure, so as to fill the cavity of the core box with the floated and fluidized core sand from within the sand blow chamber after the first step; a third step of determining after the second step by the control unit according to pressures within the sand blow chamber and sand storage chamber whether or not the filling of the cavity with the core sand is completed and stopping respective operations of the aeration air supply means and compressed air supply means according to an instruction from the control unit when the filling is completed; and a fourth step of evacuating the compressed air from within the sand blow chamber after the third step.

In the core sand filling method in accordance with one aspect of the present invention, when the pressure within the sand blow chamber reaches the first pressure, the compressed air supply means supplies the compressed air into the sand storage chamber according to an instruction from the control unit, so as to fill the cavity of the core box with floated and fluidized core sand from within the sand blow chamber. Therefore, at a point of time when the core sand within the sand blow chamber is floated and fluidized, the compressed air supply means can be operated promptly, so as to fill the cavity of the core box with the core sand in a short time. In the core sand filling method in accordance with this aspect of the present invention, according to the pressures within the sand blow chamber and sand storage chamber, the control unit determines whether the filling of the cavity with the core sand is completed or not and, when the filling is completed, the respective operations of the aeration air supply means and compressed air supply means are stopped according to an instruction from the control unit. Hence, whether the cavity of the core box is filled with the core sand or not can be detected by measuring pressures. Controlling the air supply according to the pressure within the blow head as in the foregoing can achieve both of filling the cavity of the core box with the core sand while fully floating and fluidizing the core sand and appropriately completing the filling. As a result, the core box can fully be filled with the core sand, whereby the efficiency in manufacturing cores can be improved. Whether the pressure within the sand blow chamber reaches the first pressure or not may be determined by measuring the pressure within the sand blow chamber or finding whether a predetermined time period indicating the attainment of the first pressure has passed or not.

The first pressure may be such a pressure as to be able to attain a state suitable for floating and fluidizing the core sand and blowing the core sand into the cavity. In this case, comparing the pressure within the sand blow chamber and the first pressure with each other can detect whether or not the state is suitable for floating and fluidizing the core sand and blowing the core sand into the cavity. The first pressure may be selected from the range of 0.01. MPa to 0.1 MPa, for example.

In the third step, the control unit may determine whether each of the respective pressures within the sand blow chamber and sand storage chamber reaches a second pressure or not. In this case, comparing the respective pressures within the sand blow chamber and sand storage chamber with the second pressure can detect whether the cavity of the sand box is filled with the core sand or not.

In the third step, the control unit may determine whether a first condition that each of the respective pressures within the sand blow chamber and sand storage chamber is the second pressure or higher and a second condition that a differential pressure between the pressure within the sand storage chamber and the pressure within the sand blow chamber is a third pressure or lower are satisfied or not. In this case, as the cavity of the core box is filled with the core sand, the pressure within the sand blow chamber rises so as to approach the pressure within the sand storage chamber, thereby lowering the differential pressure. Therefore, determining whether the second condition based on the differential pressure is satisfied or not can automatically detect the completion of the filling of the cavity of the core box with the core sand. The third pressure may be selected from the range of 0.002 MPa to 0.015 MPa, for example.

The third step may keep the aeration air supply means and compressed air supply means operating for a predetermined first time period after both of the first and second conditions are satisfied and then stop the respective operations of the aeration air supply means and compressed air supply means. In this case, after both the first and second conditions are satisfied, the supply of aeration air and compressed air is continued for a predetermined time period, whereby the state of core sand filling the cavity of the core box can be stabilized. The first time period may be selected from the range of 0.3 sec to 1 sec, for example.

The second pressure may be set to 75% to 80% of the pressure of the compressed air supplied from the compressed air supply means while being higher than the first pressure. In this case, by measuring the respective pressures within the sand blow chamber and sand storage chamber and comparing them with the second pressure, the compressed air is securely supplied to the sand blow chamber and sand blow chamber. Hence, the core sand can be blown into the cavity of the core box sufficiently as required.

The control unit may evaluate whether the second condition is satisfied or not according to an average value of the differential pressure within a predetermined second time period. In this case, even when noise occurs in a pressure sensor, whether the second condition is satisfied or not can be determined accurately. The second time period can be selected from the range of 0.05 sec to 0.1 sec, for example.

The core sand filling method in accordance with another aspect of the present invention is a core sand filling method in a core molding machine using an under-blow type core sand filling device for filling a core box with core sand blown from thereunder, the core sand filling device comprising the core box having a cavity to be filled with the core sand, a blow head having a sand blow chamber for blowing the core sand into the cavity and a sand storage chamber storing the core sand to be supplied to the sand blow chamber and communicating with the sand blow chamber, aeration air supply means for supplying the sand blow chamber with an aeration air for floating and fluidizing the core sand within the sand blow chamber, compressed air supply means for supplying the sand storage chamber with a compressed air, an exhaust valve for evacuating the compressed air remaining within the sand blow chamber, a first pressure sensor for measuring a pressure Pf within the sand blow chamber, a second pressure sensor for measuring a pressure Pc within the sand storage chamber, and a control unit for controlling respective operations of the aeration air supply means, compressed air supply means, and exhaust valve according to signals from the first and second pressure sensors, the core sand filling method comprising a first step of supplying an aeration air into the sand blow chamber by the aeration air supply means in a state where the blow head and the core box communicate with each other while the blow head is located under the core box, so as to float and fluidize the core sand within the sand blow chamber; a second step of determining after the first step by the control unit whether the pressure Pf of the sand blow chamber measured by the first pressure sensor reaches a first pressure P1 or not and, when the pressure Pf reaches the first pressure P1, supplying the compressed air into the sand storage chamber by the compressed air supply means according to an instruction from the control unit, so as to fill the cavity of the core box with the floated and fluidized core sand from within the sand blow chamber; a third step of determining after the second step by the control unit whether a first condition that each of the pressure Pf within the sand blow chamber and the pressure Pc within the sand storage chamber is at least a second pressure P2 higher than the first pressure P1 and a second condition that a differential pressure $\Delta P = Pc - Pf$ between the pressure Pc within the sand storage chamber and the pressure Pf within the sand blow chamber is a third pressure P3 or lower are satisfied or not and, when both the first and second conditions are satisfied, stopping the respective operations of the aeration air supply means and compressed air supply means according to an instruction from the control unit; and a fourth step of instructing the exhaust valve to open by the control unit after the third step, so as to evacuate the compressed air from within the sand blow chamber.

In the core sand filling method in accordance with this aspect of the present invention, when the pressure Pf within the sand blow chamber reaches the first pressure P1, the compressed air supply means supplies the compressed air into the sand storage chamber according to an instruction from the control unit, so as to fill the cavity of the core box with the floated and fluidized core sand from within the sand blow chamber. Therefore, the compressed air supply means can be operated promptly at the point of time when the core sand within the sand blow chamber is floated and fluidized, so as to fill the cavity of the core box with the core sand in a short time. In the core sand filling method in accordance with this aspect of the present invention, when the first condition that each of the pressure Pf within the sand blow chamber and the pressure within the sand storage chamber Pc is at least the second pressure P2 and the second condition that the differential pressure $\Delta P = Pc - Pf$ between the pressure Pc within the sand storage chamber and the pressure Pf within the sand blow chamber is the third pressure P3 or lower are satisfied, the respective operations of the aeration air supply means and compressed air supply means are stopped according to an instruction from the control unit. Therefore, whether the cavity of the core box is filled with the core sand or not can be detected by measuring pressures. As the cavity of the core box is filled with the core sand, the pressure within the sand blow chamber Pf rises, so as to approach the pressure within the sand storage chamber Pc, thereby lowering the differential pressure $\Delta P$. Therefore, determining whether the second condition based on the differential pressure $\Delta P$ is satisfied or not can automatically detect the completion of the filling of the cavity of the core box with the core sand. Controlling the air supply according to the pressure within the blow head as in the foregoing can achieve both of filling the cavity of the core box with the core sand while fully floating and fluidizing the core sand and appropriately completing the filling. As a result, the core box can favorably be filled with the core sand, whereby the efficiency in manufacturing cores can be improved.

The first pressure P1 may be such a pressure as to be able to attain a state suitable for floating and fluidizing the core sand and blowing the core sand into the cavity. In this case, comparing the pressure within the sand blow chamber and the first pressure P1 with each other can detect whether or not the state is suitable for floating and fluidizing the core sand and blowing the core sand into the cavity. The first pressure P1 may be selected from the range of 0.01 MPa to 0.1 MPa, for example. The third pressure may be selected from the range of 0.002 MPa to 0.015 MPa, for example.

The second pressure P2 may be set to 75% to 80% of the pressure of the compressed air supplied from the compressed air supply means. In this case, by measuring the respective pressures within the sand blow chamber and sand blow chamber and comparing them with the second pressure, the compressed air is securely supplied to the sand blow chamber and sand storage chamber. Hence, the core sand can be blown into the cavity of the core box sufficiently as required.

The control unit may evaluate whether the second condition is satisfied or not according to an average value of the differential pressure ΔP within a predetermined time period. In this case, even when noise occurs in any pressure sensor, whether the second condition is satisfied or not can be determined accurately. The control unit may evaluate whether the second condition is satisfied or not according to the average value of the differential pressure ΔP in a period of 0.05 sec to 0.1 sec, for example.

The third step may keep the aeration air supply means and compressed air supply means operating for a predetermined time period T1 after both of the first and second conditions are satisfied and then stop the respective operations of the aeration air supply means and compressed air supply means. In this case, after both the first and second conditions are satisfied, the supply of aeration air and compressed air is continued for a predetermined time period, whereby the state of core sand filling the cavity of the core box can be stabilized. The predetermined time period T1 may be selected from the range of 0.3 sec to 1 sec, for example.

The control unit may determine whether or not each of the first to fourth steps is completed in a predetermined time period T3 after starting the first step and, when the predetermined time period T3 has elapsed before any of the first to fourth steps is completed, stop operating the core sand filling device. This can automatically stop operating the core sand filling device by determining that an abnormality such as short supply of the compressed air or leakage of the compressed air from the blow head has occurred.

The core sand filling method in accordance with still another aspect of the present invention is a core sand filling method in a core molding machine using an under-blow type core sand filling device for filling a core box with core sand blown from thereunder, the core sand filling device comprising the core box having a cavity to be filled with the core sand, a blow head having a sand blow chamber for blowing the core sand into the cavity and a sand storage chamber storing the core sand to be supplied to the sand blow chamber and communicating with the sand blow chamber, aeration air supply means for supplying the sand blow chamber with an aeration air for floating and fluidizing the core sand within the sand blow chamber, compressed air supply means for supplying the sand storage chamber with a compressed air, an exhaust valve for evacuating the compressed air remaining within the sand blow chamber, a first pressure sensor for measuring a pressure Pf within the sand blow chamber, a second pressure sensor for measuring a pressure Pc within the sand storage chamber, and a control unit for controlling respective operations of the aeration air supply means, compressed air supply means, and exhaust valve according to signals from the first and second pressure sensors, the core sand filling method comprising a first step of supplying an aeration air into the sand blow chamber by the aeration air supply means in a state where the blow head and the core box communicate with each other while the blow head is located under the core box, so as to float and fluidize the core sand within the sand blow chamber; a second step of determining after the first step by the control unit whether a predetermined time period indicating that the pressure Pf within the sand blow chamber measured by the first pressure sensor reaches a first pressure P1 has passed or not and, when the predetermined time period has passed, supplying the compressed air into the sand storage chamber by the compressed air supply means according to an instruction from the control unit, so as to fill the cavity of the core box with the floated and fluidized core sand from within the sand blow chamber; a third step of determining after the second step by the control unit whether a first condition that each of the pressure Pf within the sand blow chamber and the pressure Pc within the sand storage chamber is at least a second pressure P2 higher than the first pressure P1 and a second condition that a differential pressure ΔP=Pc−Pf between the pressure Pc within the sand storage chamber and the pressure Pf within the sand blow chamber is a third pressure P3 or lower are satisfied or not and, when both the first and second conditions are satisfied, stopping the respective operations of the aeration air supply means and compressed air supply means according to an instruction from the control unit; and a fourth step of instructing the exhaust valve to open by the control unit after the third step, so as to evacuate the compressed air from within the sand blow chamber.

In the core sand filling method in accordance with this aspect of the present invention, when a predetermined time period indicating that the pressure Pf within the sand blow chamber reaches the first pressure P1 has passed, the compressed air supply means supplies the compressed air into the sand storage chamber according to an instruction from the control unit, so as to fill the cavity of the core box with the floated and fluidized core sand from within the sand blow chamber. Therefore, the compressed air supply means can be operated promptly at the point of time when the core sand within the sand blow chamber is floated and fluidized, so as to fill the cavity of the core box with the core sand in a short time. In the core sand filling method in accordance with this aspect of the present invention, when the first condition that each of the pressure Pf within the sand blow chamber and the pressure within the sand storage chamber Pc is at least the second pressure P2 and the second condition that the differential pressure ΔP=Pc−Pf between the pressure Pc within the sand storage chamber and the pressure Pf within the sand blow chamber is the third pressure P3 or lower are satisfied, the respective operations of the aeration air supply means and compressed air supply means are stopped according to an instruction from the control unit. Therefore, whether the cavity of the core box is filled with the core sand or not can be detected by measuring pressures. As the cavity of the core box is filled with the core sand, the pressure within the sand blow chamber Pf rises, so as to approach the pressure within the sand storage chamber Pc, thereby lowering the differential pressure ΔP. Therefore, determining whether the second condition based on the differential pressure ΔP is satisfied or not can automatically detect the completion of the filling of the cavity of the core box with the core sand. Controlling the air supply according to the pressure within the blow head as in the foregoing can achieve both of filling the cavity of the core box with the core sand while fully floating and fluidizing the core sand and appropriately completing the filling. As a result, the core box can favorably be filled with the core sand, whereby the efficiency in manufacturing cores can be improved.

The core manufacturing method in accordance with yet another aspect of the present invention is a core manufacturing method for manufacturing a core by filling a cavity of a core box with core sand from a blow head having a sand blow chamber and a sand storage chamber, the method comprising a first step of supplying an aeration air into the sand blow chamber by aeration air supply means in a state where the blow head and the core box communicate with each other while the blow head is located under the core box, so as to float and fluidize the core sand within the sand blow chamber; a second step of supplying a compressed air into the sand storage chamber by compressed air supply means according to an instruction from a control unit when a pressure within the sand blow chamber reaches a first pressure, so as to fill the cavity of the core box with the floated and fluidized core sand from within the sand blow chamber after the first step; a third step of determining after the second step by the control unit according to pressures within the sand blow chamber and sand storage chamber whether or not the filling of the cavity with the core sand is completed, determining by the control unit whether each of the respective pressures within the sand blow chamber and sand storage chamber reaches a second pressure higher than the first pressure, and stopping respective operations of the aeration air supply means and compressed air supply means according to an instruction from the control unit when each of the pressures reaches the second pressure; a fourth step of evacuating the compressed air from within the sand blow chamber after the third step; and a fifth step of solidifying the core sand within the cavity of the core box, so as to mold the core.

In the core manufacturing method in accordance with this aspect of the present invention, when the pressure within the sand blow chamber reaches the first pressure, the compressed air supply means supplies the compressed air into the sand storage chamber according to an instruction from the control unit, so as to fill the cavity of the core box with floated and fluidized core sand from within the sand blow chamber. Therefore, at a point of time when the core sand within the sand blow chamber is floated and fluidized, the compressed air supply means can be operated promptly, so as to fill the cavity of the core box with the core sand in a short time. In the core sand filling method in accordance with this aspect of the present invention, according to the pressures within the sand blow chamber and sand storage chamber, the control unit determines whether the filling of the cavity with the core sand is completed or not and, when the filling is completed, the respective operations of the aeration air supply means and compressed air supply means are stopped according to an instruction from the control unit. Hence, whether the cavity of the core box is filled with the core sand or not can be detected by measuring pressures. Controlling the air supply according to the pressure within the blow head as in the foregoing can achieve both of filling the cavity of the core box with the core sand while fully floating and fluidizing the core sand and appropriately completing the filling. As a result, the core box can fully be filled with the core sand, whereby the efficiency in manufacturing cores can be improved.

The core manufacturing method in accordance with a further aspect of the present invention is a core sand filling method in a core molding machine using an under-blow type core sand filling device for filling a core box with core sand blown from thereunder, the core sand filling device comprising the core box having a cavity to be filled with the core sand, a blow head having a sand blow chamber for blowing the core sand into the cavity and a sand storage chamber storing the core sand to be supplied to the sand blow chamber and communicating with the sand blow chamber, aeration air supply means for supplying the sand blow chamber with an aeration air for floating and fluidizing the core sand within the sand blow chamber, compressed air supply means for supplying the sand storage chamber with a compressed air, an exhaust valve for evacuating the compressed air remaining within the sand blow chamber, a first pressure sensor for measuring a pressure Pf within the sand blow chamber, a second pressure sensor for measuring a pressure Pc within the sand storage chamber, and a control unit for controlling respective operations of the aeration air supply means, compressed air supply means, and exhaust valve according to signals from the first and second pressure sensors, the core sand filling method comprising a first step of supplying an aeration air into the sand blow chamber by the aeration air supply means in a state where the blow head and the core box communicate with each other while the blow head is located under the core box, so as to float and fluidize the core sand within the sand blow chamber; a second step of determining after the first step by the control unit whether the pressure Pf of the sand blow chamber measured by the first pressure sensor reaches a first pressure P1 or not and, when the pressure Pf reaches the first pressure P1, supplying the compressed air into the sand storage chamber by the compressed air supply means according to an instruction from the control unit, so as to fill the cavity of the core box with the floated and fluidized core sand from within the sand blow chamber; a third step of determining after the second step by the control unit whether a first condition that each of the pressure Pf within the sand blow chamber and the pressure Pc within the sand storage chamber is at least a second pressure P2 higher than the first pressure P1 and a second condition that a differential pressure $\Delta P = Pc - Pf$ between the pressure Pc within the sand storage chamber and the pressure Pf within the sand blow chamber is a third pressure P3 or lower are satisfied or not and, when both the first and second conditions are satisfied, stopping the respective operations of the aeration air supply means and compressed air supply means according to an instruction from the control unit; a fourth step of instructing the exhaust valve to open by the control unit after the third step, so as to evacuate the compressed air from within the sand blow chamber; and a fifth step of solidifying the core sand within the cavity of the core box, so as to mold the core.

In the core manufacturing method in accordance with this aspect of the present invention, when the pressure Pf within the sand blow chamber reaches the first pressure P1, the compressed air supply means supplies the compressed air into the sand storage chamber according to an instruction from the control unit, so as to fill the cavity of the core box with the floated and fluidized core sand from within the sand blow chamber. Therefore, the compressed air supply means can be operated promptly at the point of time when the core sand within the sand blow chamber is floated and fluidized, so as to fill the cavity of the core box with the core sand in a short time. In the core manufacturing method in accordance with this aspect of the present invention, when the first condition that each of the pressure Pf within the sand blow chamber and the pressure within the sand storage chamber Pc is at least the second pressure P2 and the second condition that the differential pressure $\Delta P = Pc - Pf$ between the pressure Pc within the sand storage chamber and the pressure Pf within the sand blow chamber is the third pressure P3 or lower are satisfied, the respective operations of the aeration air supply means and compressed air supply means are stopped according to an instruction from the control unit. Therefore, whether the cavity of the core box is filled with the core sand or not can be detected by measuring pressures. As the cavity of the core box is filled with the core sand, the pressure within the sand blow chamber Pf rises, so as to approach the pressure within the sand storage chamber Pc, thereby lowering the differential pressure $\Delta P$. Therefore, determining whether the second condition based on the differential pressure ΔP is satisfied or not can automatically detect the completion of the filling of the cavity of the core box with the core sand. Controlling the air supply according to the pressure within the blow head as in the foregoing can achieve both of filling the cavity of the core box with the core sand while fully floating and fluidizing the core sand and appropriately completing the filling. As a result, the core box can favorably be filled with the core sand, whereby the efficiency in manufacturing cores can be improved.

The core manufacturing method in accordance with a still further aspect of the present invention is a core sand filling method in a core molding machine using an under-blow type core sand filling device for filling a core box with core sand blown from thereunder, the core sand filling device comprising the core box having a cavity to be filled with the core sand, a blow head having a sand blow chamber for blowing the core sand into the cavity and a sand storage chamber storing the core sand to be supplied to the sand blow chamber and communicating with the sand blow chamber, aeration air supply means for supplying the sand blow chamber with an aeration air for floating and fluidizing the core sand within the sand blow chamber, compressed air supply means for supplying the sand storage chamber with a compressed air, an exhaust valve for evacuating the compressed air remaining within the sand blow chamber, a first pressure sensor for measuring a pressure Pf within the sand blow chamber, a second pressure sensor for measuring a pressure Pc within the sand storage chamber, and a control unit for controlling respective operations of the aeration air supply means, compressed air supply means, and exhaust valve according to signals from the first and second pressure sensors, the core sand filling method comprising a first step of supplying an aeration air into the sand blow chamber by the aeration air supply means in a state where the blow head and the core box communicate with each other while the blow head is located under the core box, so as to float and fluidize the core sand within the sand blow chamber; a second step of determining after the first step by the control unit whether a predetermined time period indicating that the pressure Pf within the sand blow chamber measured by the first pressure sensor reaches a first pressure P1 has passed or not and, when the predetermined time period has passed, supplying the compressed air into the sand storage chamber by the compressed air supply means according to an instruction from the control unit, so as to fill the cavity of the core box with the floated and fluidized core sand from within the sand blow chamber; a third step of determining after the second step by the control unit whether a first condition that each of the pressure Pf within the sand blow chamber and the pressure Pc within the sand storage chamber is at least a second pressure P2 higher than the first pressure P1 and a second condition that a differential pressure ΔP=Pc−Pf between the pressure Pc within the sand storage chamber and the pressure Pf within the sand blow chamber is a third pressure P3 or lower are satisfied or not and, when both the first and second conditions are satisfied, stopping the respective operations of the aeration air supply means and compressed air supply means according to an instruction from the control unit; a fourth step of instructing the exhaust valve to open by the control unit after the third step, so as to evacuate the compressed air from within the sand blow chamber; and a fifth step of solidifying the core sand within the cavity of the core box, so as to mold the core.

In the core manufacturing method in accordance with this aspect of the present invention, when a predetermined time period indicating that the pressure Pf within the sand blow chamber measured by the first pressure sensor reaches the first pressure P1 has passed, the compressed air supply means supplies the compressed air into the sand, storage chamber according to an instruction from the control unit, so as to fill the cavity of the core box with the floated and fluidized core sand from within the sand blow chamber. Therefore, the compressed air supply means can be operated promptly at the point of time when the core sand within the sand blow chamber is floated and fluidized, so as to fill the cavity of the core box with the core sand in a short time. In the core manufacturing method in accordance with this aspect of the present invention, when the first condition that each of the pressure Pf within the sand blow chamber and the pressure within the sand storage chamber Pc is at least the second pressure P2 and the second condition that the differential pressure ΔP=Pc−Pf between the pressure Pc within the sand storage chamber and the pressure Pf within the sand blow chamber is the third pressure P3 or lower are satisfied, the respective operations of the aeration air supply means and compressed air supply means are stopped according to an instruction from the control unit. Therefore, whether the cavity of the core box is filled with the core sand or not can be detected by measuring pressures. As the cavity of the core box is filled with the core sand, the pressure within the sand blow chamber Pf rises, so as to approach the pressure within the sand storage chamber Pc, thereby lowering the differential pressure ΔP. Therefore, determining whether the second condition based on the differential pressure ΔP is satisfied or not can automatically detect the completion of the filling of the cavity of the core box with the core sand. Controlling the air supply according to the pressure within the blow head as in the foregoing can achieve both of filling the cavity of the core box with the core sand while fully floating and fluidizing the core sand and appropriately completing the filling. As a result, the core box can favorably be filled with the core sand, whereby the efficiency in manufacturing cores can be improved.

Advantageous Effects of Invention

The present invention can provide a core sand filling method and core manufacturing method which, when employing the under-blow type for blowing core sand into a core box located on the upper side, can favorably fill the core box with the core sand, thereby contributing to improving the efficiency in manufacturing cores.

DESCRIPTION OF EMBODIMENTS

Figure 1:
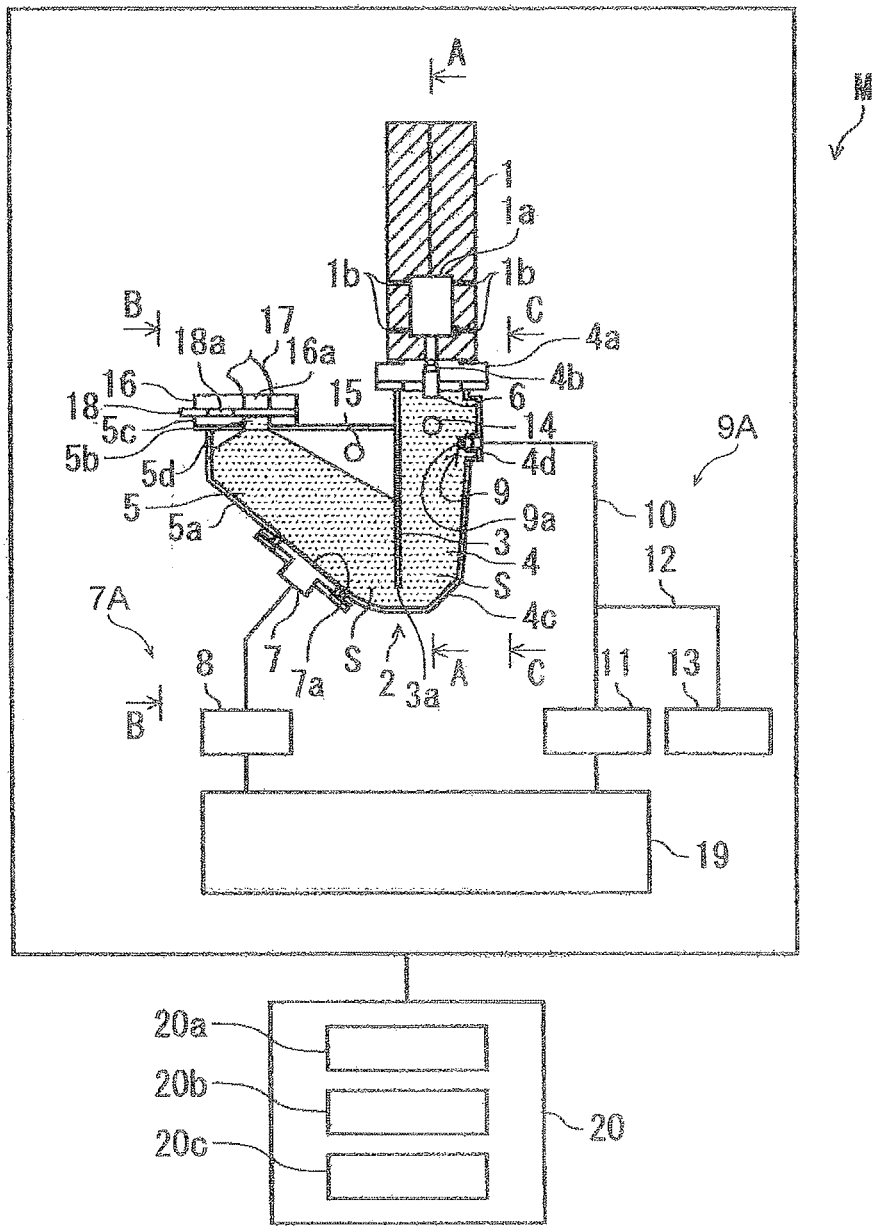
FIG. 1 is a cross-sectional explanatory view illustrating a structure of a core sand filling device using a core sand filling method of the present invention.
Figure 2:
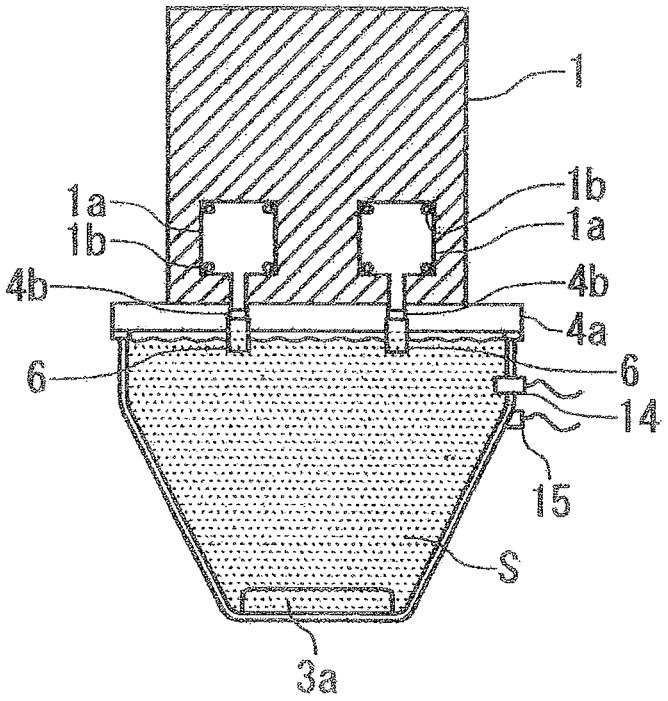
FIG. 2 is an explanatory cross-sectional view taken along the line A-A of FIG. 1.
Figure 3:
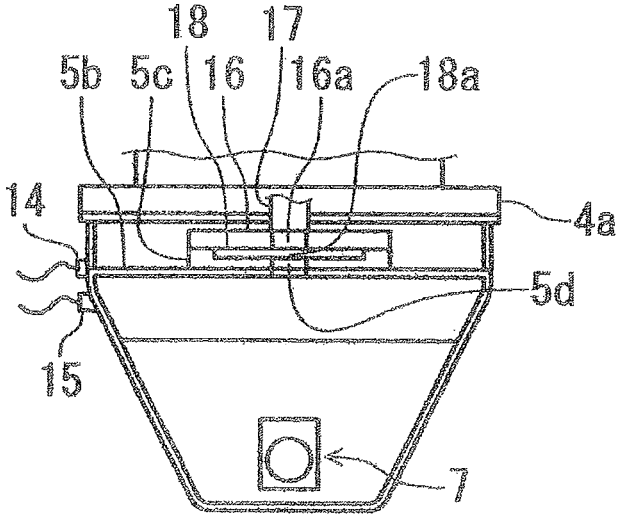
FIG. 3 is an explanatory view along the line B-B of FIG. 1.
Figure 4:
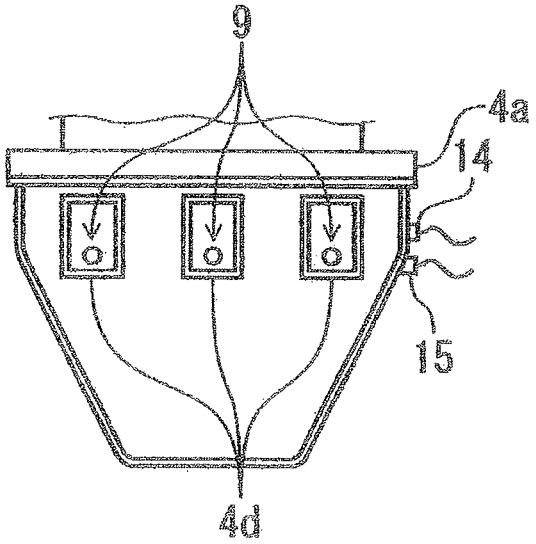
FIG. 4 is an explanatory view along the line C-C of FIG. 1.

The core sand filling method and core manufacturing method in accordance with an embodiment will be explained with reference to the drawings. By the core molding machine in this embodiment is meant one molding (manufacturing) a core (including a master mold when molding the same) by blowing core sand into a mold, examples of which include shell machines, cold box molding machines, and greensand mold core molding machines. This embodiment illustrates an example using a shell core molding machine, which fills a heated mold with resin-coated sand blown thereinto so as to mold a shell core, as a core molding machine. The core sand filling device is an under-blow type core sand filling device winch blows core sand into a core box on the upper side from thereunder. The drawings mainly illustrate the core sand filling device in the core molding machine, while omitting constituents of the core molding machine other than the core sand filling device as appropriate.

As FIGS. 1 to 4 illustrate, in a core sand filling device M, an assembled core box 1 and a blow head 2, which is located under the core box 1 and adapted to move up and down relative to the core box 1, are arranged. The blow head 2, which is linked to an undepicted lift cylinder, is configured such as to be able to move up and down with respect to the core box 1 arranged at a predetermined position.

The blow head 2 is divided by a partition 3 disposed at an intermediate position thereof into two chambers, i.e., a sand blow chamber 4 for filling a cavity 1*a* of the core box 1 with core sand blown thereinto and a sand storage chamber 5 for supplying the core sand into the sand blow chamber 4.

A plate 4*a* in close contact with the core box 1 is attached to the upper end of the sand blow chamber 4. The plate 4*a* is provided with a sand blow hole 4*b* for blowing core sand S from within the sand blow chamber 4 into the cavity 1*a* of the core box 1. The core box 1 is provided with vent holes 1*b* communicating with the cavity 1*a*.

A sand blow nozzle 6 which communicates the sand blow chamber 4 and the cavity 1*a* of the core box 1 to each other is disposed at the lower end of the sand blow hole 4*b*.

An opening 3*a* (see FIG. 2) is formed at the center in a lower part of the partition 3. The sand blow chamber 4 and the sand storage chamber 5 communicate with each other through the opening 3*a*. The sand storage chamber 5 has a bottom face, a part of which forms a slope 5*a* (see FIG. 1) tilted toward the sand blow chamber 4. The upper face of a ceiling board 5*b* of the sand storage chamber 5 is positioned lower than the upper face of the plate 4*a* in the sand blow chamber 4.

A compressed air supply port 7 for supplying a compressed air into the sand storage chamber 5 is mounted to a lower part of the slope 5*a* in the sand storage chamber 5 so as to communicate with the sand storage chamber 5. A porous sintered body 7*a* made of bronze is mounted to a leading end of the compressed air supply port 7. The compressed air supply port 7 is connected through an on/off valve 8 to a compressed air supply source 19 equipped with a compressor and an air tank, for example. In this embodiment, the compressed air supply port 7, sintered body 7*a*, on/off valve 8, and compressed air supply source 19 constitute a compressed air supply means 7A.

An aeration air supply port 9 is mounted through a plate member 4*d* to an upper part of a side wall in the sand blow chamber 4 so as to communicate with the sand blow chamber 4. The aeration air supply port 9 supplies into the sand blow chamber 4 an aeration air for floating and fluidizing the core sand therewithin. A porous sintered body 9*a* made of bronze is mounted to the leading end of the aeration air supply port 9. The aeration air supply port 9 is connected to the compressed air supply source 19 through an air pipe 10 and an on/off valve 11. In this embodiment, the aeration air supply port. 9, sintered body 9*a*, air pipe 10, on/off valve 11, and compressed air supply source 19 constitute an aeration air supply means 9A.

A branch air pipe 12 connected to an exhaust valve 13 for evacuating the compressed air remaining within the sand blow chamber 4 is provided in the middle of the air pipe 10.

In the sand blow chamber 4, a first pressure sensor 14 for measuring the pressure within the sand blow chamber 4 is mounted to an upper part of a side wall orthogonal to the side wall provided with the aeration air supply port 9. A second pressure sensor 15 for measuring the pressure within the sand storage chamber 5 is mounted to an upper part of a side wall in the sand storage chamber 5.

A plank 5*c* is attached to the upper end of the sand storage chamber 5. A sand inlet hole 5*d* penetrates through the ceiling board 5*b* and plank 5*c* of the sand storage chamber 5. A flange 16 provided with a through hole 16*a* is disposed above the plank 5*c*. A sand supply pipe 17 communicating with the through hole 16*a* is firmly attached to the upper end of the flange 16. The sand supply pipe 17 is connected through an undepicted sand supply hose to a sand hopper (not depicted) for storing/supplying the core sand.

An on/off gate 18 provided with a communication hole 18*a* is disposed between the plank 5*c* and the flange 16. The on/off gate 18 is constructed such as to be opened and closed (moved left and right) by an undepicted cylinder. When the blow head 2 is moved up and down by the undepicted lift cylinder, the plank 5*c*, on/off gate 18, flange 16, and sand supply pipe 17 also move up and down.

A controller 20 has a control unit 20*a*, a timer 20*b*, and a determination unit 20*c*. The control unit. 20*a* controls operations of individual parts of the core sand filling device M. The timer 20*b* counts the operation time of the core sand filling device M. The determination unit 20*c* performs determinations according to the pressure measured by the first pressure sensor 14, the pressure measured by the second pressure sensor 15, the time counted by the timer 20*b*, and the like and outputs instruction signals to the control unit 20*a*. In this embodiment, the controller 20 may be a personal computer, a programmable logic controller (PLC), or any of other types of electronic calculators and processors, for example. The timer 20*b* may be provided separately from the controller 20.

[Core Sand Filling Method in the Core Sand Filling Device]

Figure 5:
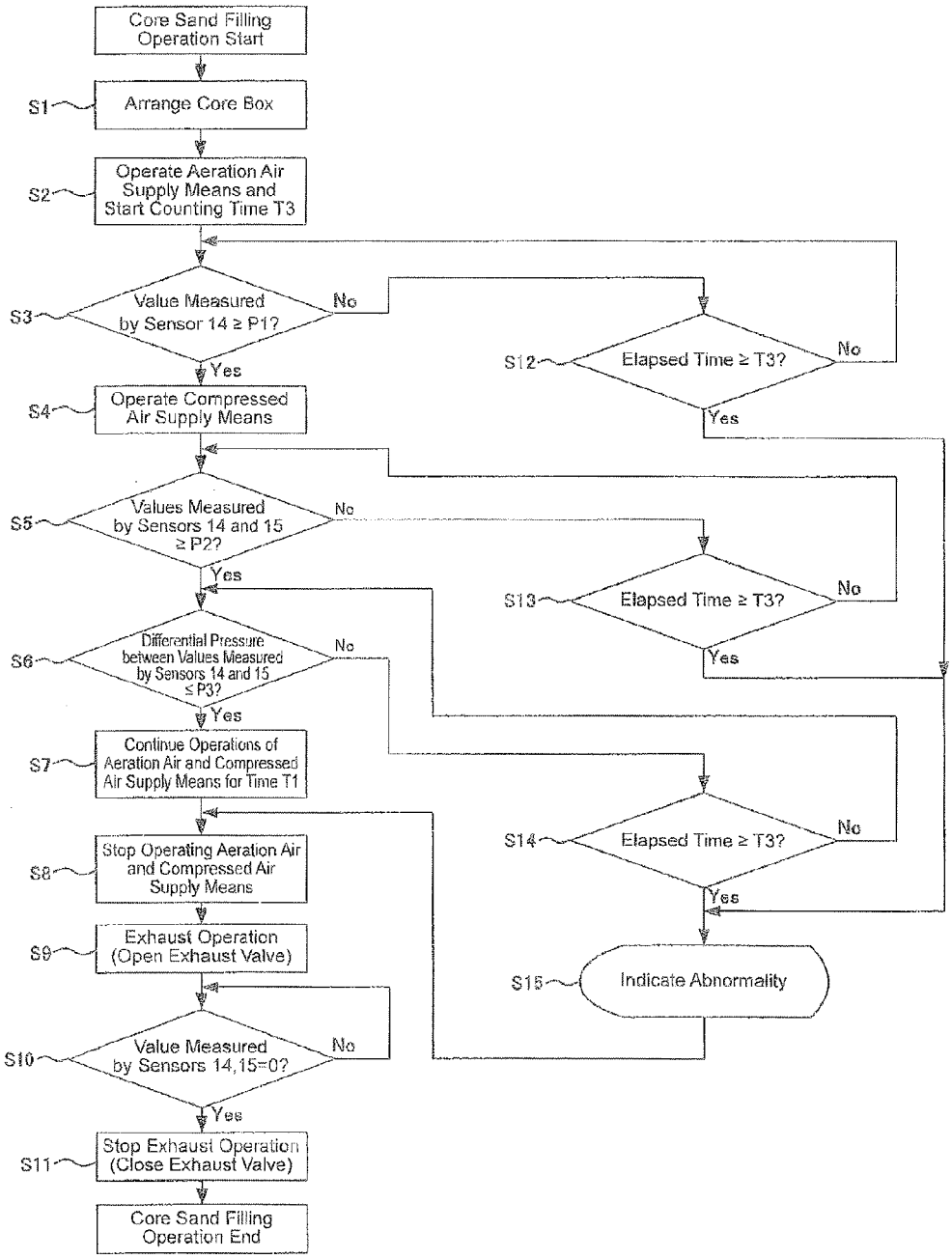
FIG. 5 is an explanatory diagram illustrating steps of the core sand filling method in accordance with the present invention.
Figure 6:
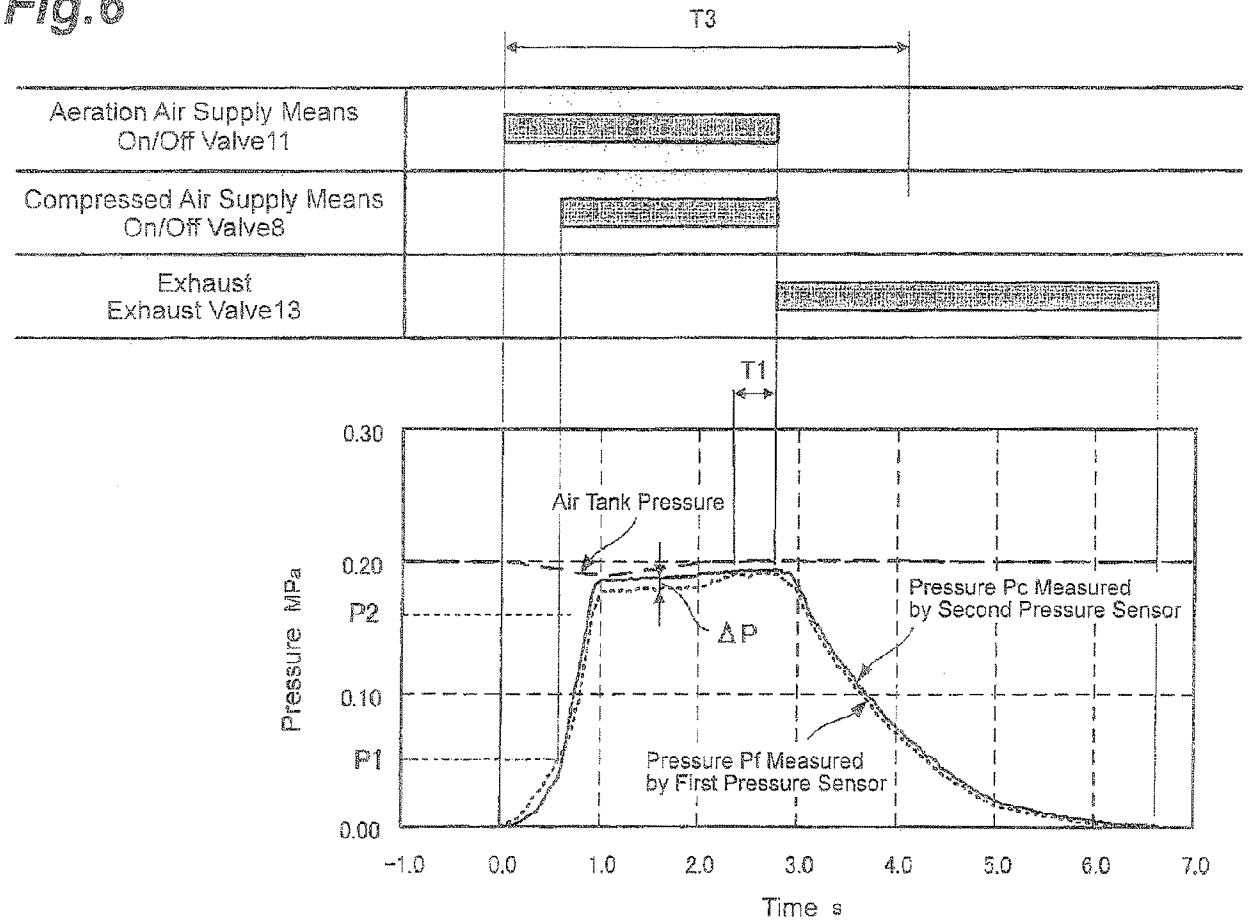
FIG. 6 is an explanatory diagram illustrating operation timings of an aeration air supply means, a compressed air supply means, and an exhaust valve.

A method for filling the cavity 1*a* of the core box 1 with core sand by the core sand filling device M will now be explained with reference to FIGS. 5 and 6. In FIG. 6, the upper part is an explanatory diagram illustrating operation timings of the aeration air supply means 9A, compressed air supply means 7A, and exhaust valve 13 (operated in the hatched parts), while the lower part is an explanatory diagram illustrating changes in pressure within the sand blow chamber 4 and sand storage chamber 5.

First, pressures P1, P2, P3, time periods T1, T3, and the like, which will be explained later, are registered in the controller 20. At step S1, the control unit 20*a* instructs the core sand filling device M to arrange the core box 1 at a predetermined position and close the on/off valve with an undepicted cylinder. Thereafter, the control unit 20*a* instructs the core sand filling device M to raise the blow head 2 with an undepicted lift cylinder, so as to achieve the state illustrated in FIG. 1 in which the core box 1 and the plate 4*a* are in close contact with each other. At this time, the sand inlet hole 5*d* is closed with the on/off gate 18, so that the blow head 2 has a sealed space therewithin. The sand blow chamber 4 and sand storage chamber 5 contain respectively required amounts of core sand S therewithin.

At subsequent step S2, the control unit 20*a* instructs the aeration air supply means 9A to open the on/off valve 11 and starts the tinier 20*b* to count the time elapsed. This allows the sintered body 9*a* mounted to the leading end of the aeration air supply port 9 to spout a compressed air (aeration air), thereby floating and fluidizing the core sand within the sand blow chamber 4. When the aeration air supply means is operated, as FIG. 6 illustrates, the pressure Pf measured by the first pressure sensor 14 mounted to the sand blow chamber 4 rises, and the pressure Pc measured by the second pressure sensor 15 mounted to the sand storage chamber 5 rises so as to follow the former pressure.

When the aeration air supply means 9A is operated, so as to open the on/off valve 11, the core sand within the sand blow chamber 4 is floated and fluidized, while a part of the core sand is blown from within the sand blow chamber 4 into the cavity 1*a* of the core box 1, if this state continues for a long time, the cavity 1*a* may insufficiently be filled with the core sand, thus producing parts with a low core sand packing density in the core and wrinkles on the surface of the core. Therefore, the compressed air supply means 7A may be operated promptly at the point of time when the core sand within the sand blow chamber 4 is floated and fluidized, so as to fill the cavity 1*a* in a short time.

At subsequent step S3, the controller 20 (control unit 20*a*) determines whether the pressure Pf measured by the first pressure sensor 14 reaches a preset first pressure P1 or not. Here, the first pressure P1 is a pressure suitable for floating and fluidizing the core sand sufficiently within the sand blow chamber 4 and blowing the core sand into the cavity 1*a* and may be set within the range of 0.01 to 0.1. MPa or, more specifically, 0.03 to 0.07 MPa.

The controller 20 (control unit 20*a*) proceeds to step S4 when it is determined that the pressure Pf measured by the first pressure sensor 14 reaches the first pressure P1 (YES at step S3) and step S12 when it is determined that the pressure Pf measured by the first pressure sensor 14 does not reach the first pressure P1 (NO at step S3).

At step S12, the controller 20 (control unit 20*a*) determines whether a preset time period (third time period 13) has passed since the aeration air supply means 9A was started. When it is determined that the time elapsed is less than the third time T3 (NO at step S12), the process returns to step S3. When the pressure Pf measured by the first pressure sensor 14 does not reach the predetermined pressure (P1) after the lapse of the predetermined time period (T3) from the starting of the aeration air supply means 9A (YES at step S12), an abnormality such as short supply of the compressed air or leakage of the compressed air from the blow head 2 may exist, whereby the process proceeds to step S15. For example, the controller 20 issues an indication of abnormality and an alarm to its display at step S15 and proceeds to step S8, thereby terminating the operation of filling with the core sand. Here, the third time period T3 may be set within the range of 4 to 10 sec.

At step S4, the control unit 20*a* instructs the compressed air supply means 7A to open the on/off valve 8. This allows the sintered body 7*a* mounted to the leading end of the compressed air supply port 7 to spout the compressed air, thereby feeding the core sand from within the sand storage chamber 5 into the sand blow chamber 4. As a consequence, the core sand within the sand blow chamber 4 is blown into the cavity 1*a* of the core box 1 through the sand blow nozzle 6 and sand blow hole 4*b*. Here, the compressed air blown into the cavity 1*a* together with the core sand is evacuated through the vent holes 1*b*. Since the core sand is fully floated and fluidized, the cavity 1*a* can securely be filled therewith. At the point of time when the core sand within the sand blow chamber 4 is floated and fluidized, the compressed air supply means 7A can be operated promptly so as to fill the cavity 1*a* in a short time, whereby good cores can be molded (manufactured) stably.

When the pressures measured by the first and second pressure sensors 14, 15 at this time are observed, as FIG. 6 illustrates, the pressure in the sand storage chamber 5, i.e., the pressure Pc measured by the second pressure sensor 15, increases rapidly, so as to become higher than the pressure in the sand blow chamber 4, i.e., the pressure Pc measured by the first pressure sensor 14.

At subsequent step S5, the controller 20 (control unit 20*a*) determines whether each of the pressure Pf measured by the first pressure sensor 14 and the pressure Pc measured by the second pressure sensor 15 reaches a preset second pressure P2 or not. Here, the second pressure P2 is a detection pressure for seeing that the compressed air is securely supplied to the sand blow chamber 4 and sand storage chamber 5 so that the core sand is blown into the cavity 1*a*. The second pressure P2 may be set to about 75% to 80% of the pressure of the compressed air supplied from the compressed air supply source 19.

The controller 20 (control unit 20*a*) proceeds to step S6 when it is determined that each of the pressure Pf measured by the first pressure sensor 14 and the pressure Pc measured by the second pressure sensor 15 reaches the second pressure P2 (YES at step S5) and step S13 when it is determined that the any of pressure Pf and pressure Pc does not reach the second pressure P2 (NO at step S5).

At step S13, like step S12, the controller 20 (control unit 20*a*) determines whether the third time period T3 has passed or not. When it is determined that the third time period T3 has not passed (NO at step S13), the process returns to step S5. When any of the pressure Pf measured by the first pressure sensor 14 and the pressure Pc measured by the second pressure sensor 15 fails to reach the second pressure P2 after the lapse of the third time period T3 (YES at step S13), an abnormality such as short supply of the compressed air or leakage of the compressed air from the blow head 2 may exist, whereby the process proceeds to step S15. For example, the controller 20 issues an indication of abnormality and an alarm to its display at step S15 and proceeds to step S8, thereby terminating the operation of filling with the core sand.

At subsequent step S6, the controller 20 (control unit 20*a*) determines whether the differential pressure $\Delta P = Pc - Pf$ between the pressure Pf measured by the first pressure sensor 14 and the pressure Pc measured by the second pressure sensor 15 fails to reach a preset third pressure P3 or not. The pressure Pf measured by the first pressure sensor 14 and the pressure Pc measured by the second pressure sensor 15 stop rising when approaching the pressure of the compressed air supplied from the compressed air supply source 19, for example, the pressure of the air tank supplying the compressed air. Since the compressed air is continuously supplied into the sand storage chamber 5, the pressure Pc measured by the second pressure sensor 15 becomes higher than the pressure Pf measured by the first pressure sensor 14 mounted to the sand blow chamber 4 on the side evacuated through the vent holes 1*b*. Therefore, the differential pressure $\Delta P$ occurs between the pressure Pc measured by the first pressure sensor 14 and the pressure Pf measured by the second pressure sensor 15. As the cavity 1*a* of the core box 1 is filled with the core sand blown thereinto and then the nozzle 6 and sand blow hole 4*b* are filled with the core sand, the ventilation resistance for the compressed air therebetween increases, thereby reducing the amount of exhaust from the vent holes 1*b*. Therefore, the pressure within the sand blow chamber 4 increases, so as to approach the pressure within the sand storage chamber 5, thereby lowering the differential pressure $\Delta P$. Hence, the completion of filling with the core sand can be detected according to the differential pressure $\Delta P$. The third pressure P3 may be set within the range of 0.002 MPa to 0.015 MPa. Since the differential pressure ΔP is determined according to a minute pressure difference, while taking account of noise in the pressure sensors, the controller 20 may evaluate its average value in a predetermined time period (second time period T2) (e.g., the average of measured values in the period of 0.05 to 0.1 sec), for example, so as to improve the accuracy in detection.

The controller 20 (control unit 20*a*) proceeds to step S7 when it is determined that the differential pressure ΔP fails to reach the third pressure P3 (YES at step S6) and step S14 when it is determined that the differential pressure ΔP does not fail to reach the third pressure P3 (NO at step S6).

At step S14, like step S12, the controller 20 (control unit 20*a*) determines whether the third time period T3 has passed or not. When it is determined that the third time period T3 has not passed, the process returns to step S6. When the differential pressure ΔP is higher than the third pressure P3 after the lapse of the third time period T3 (YES at step S14), an abnormality such as short supply of the compressed air or leakage of the compressed air from the blow head 2 may exist, whereby the process proceeds to step S15. For example, the controller 20 issues an indication of abnormality and an alarm to its display at step S15 and proceeds to step S8, thereby terminating the operation of filling with the core sand.

At subsequent step S7, the operations of the aeration air supply means 9A and compressed air supply means 7A are continued for a predetermined time period (first time period T1) after the differential pressure ΔP became the third pressure P3 or lower. This can stabilize the state of the core sand filling the cavity 1*a*. Here, T2 may be set within the range of about 03 to 1 sec.

At sequent step S8, the control unit 20*a* instructs the aeration air supply means 9A and compressed air supply means 7A to close the on/off valves 11, 8 and stop operating the aeration air supply means 9A and compressed air supply means 7A. At this time, because of the evacuation through the vent holes 1*b*, the pressure within the cavity 1*a* is lower than that within the sand blow chamber 4. Therefore, such a pressure acts on the core sand within the sand blow chamber 4 and sand storage chamber 5 as to make it migrate into the cavity 1*a* of the core box 1, whereby the core sand filling the cavity 1*a* does not fall out.

At subsequent step 9, the control unit 20*a* instructs the exhaust valve 13 to open it: This evacuates the compressed air remaining within the sand blow chamber 4. The compressed air remaining within the sand blow chamber 4 enters the aeration air supply port 9 through the sintered body 9*a*, travels through the air pipe 10 and branch air pipe 12, and then exits from the exhaust valve 13. At this time, such an airflow occurs that the compressed air remaining within the sand blow chamber 4 and sand storage chamber 5 enters the aeration air supply port 9 through the sintered body 9*a*, along which the core sand migrates from within the sand storage chamber 5 into the sand blow chamber 4, thereby filling the latter.

At subsequent step 10, the controller 20 (control unit 20*a*) determines whether each of the pressures measured by the first and second sensors 14, 15 is substantially zero in terms of relative pressure (gauge pressure) or not. When it is determined that each of the pressures measured by the first and second sensors 14, 15 is zero (YES at step S10), the process proceeds to step S11; when determined not zero (NO at step S10), the process waits until it becomes zero.

At subsequent step 11, the exhaust valve 13 is closed, so as to terminate a series of core sand filling processing.

Thereafter, the control unit 20*a* instructs the core sand filling device M to move down the blow head 2 by the undepicted lift cylinder, so as to separate the core box 1 and the blow head 2 from each other. Next, the control unit 20*a* instructs the core sand filling device M to move the core box 1 horizontally and then disassemble the box, so as to take out the manufactured core. Subsequently, the on/off gate 18 is opened, so that core sand is supplied from within the sand hopper into sand storage chamber 5 through the sand supply pipe 17, through hole 16*a*, communication hole 18*a*, and sand inlet hole 5*d*, so as to get ready for the next core sand filling processing.

Effects of the Embodiment

In the core sand filling method of the present invention, when the pressure Pf of the sand blow chamber 4 measured by the first pressure sensor 14 reaches the preset first pressure P1, the step of operating the compressed air supply means 7A (step S3) operates the compressed air supply means 7A promptly at the point of time when the core sand within the sand blow chamber 4 is floated and fluidized, whereby the cavity 1*a* can be filled in a short time. Even with core boxes changing their cavity volumes upon replacement and thus varying the time required for completing the filling, good cores without poor filling can be molded stably.

The completion of filling the cavity of the core box with core sand can be detected when each of the pressure Pf within the sand blow chamber 4 and the pressure Pc within the sand storage chamber 5 is the preset second pressure P2 or higher (step S5) while the differential pressure ΔP=Pc−Pf between the pressure within the sand blow chamber 4 and the pressure within the sand storage chamber 5 is the preset third pressure P3 or lower (step S6), and operations of the aeration air supply means and compressed air supply means 7A can be continued for a predetermined time period (first time period T1) (step S7) and then stopped (step S8). This can cut down the time required for the step of filling with the core sand and reduce the amount of the compressed air used.

While shell molding heats a die, a compressed air supplied after the completion of filling with the core sand, if any, is evacuated through the cavity 1*a* of the core box 1 and thus takes heat away from the core box 1, thereby elongating the core firing time and necessitating extra heating energy. However, the core sand filling method and core manufacturing method in accordance with this embodiment can eliminate such extra heating energy.

Another Embodiment

Instead of the step S3, a time period corresponding to that by which the pressure Pf measured by the first pressure sensor 14 reaches the first pressure P1 may be determined and set beforehand and, when the time elapsed after starting the aeration air supply means 9A as counted by the timer 20*b* reaches the preset time, the control unit 20*a* may instruct the compressed air supply means 7A to open the on/off valve 8. This also makes it possible for the compressed air supply means 7A to operate promptly at the point of time when the core sand within the sand blow chamber 4 is floated and fluidized, thereby filling the cavity 1*a* in a short time.

REFERENCE SIGNS LIST

1 . . . core box; 1*a* . . . cavity; 1*b* . . . vent hole; 2 . . . blow head; 3 . . . partition; 4 . . . sand blow chamber; 5 . . . sand storage chamber; 7A . . . compressed air supply means; 8 . . . on/off valve; 9A . . . aeration air supply means; 10 . . . air pipe; 11 . . . on/off valve; 13 . . . exhaust valve;

14 . . . first pressure sensor; 15 . . . second pressure sensor; 16 . . . flange; 17 . . . sand supply pipe; 18 . . . on/off gate; 19 . . . compressed air supply source; 20 . . . controller; 20*a* . . . control unit; 20*b* . . . timer; 20*c* . . . determination unit; M . . . core sand filling device

The invention claimed is:

1. A core sand filling method for filling a cavity of a core box with core sand from a blow head having a sand blow chamber and a sand storage chamber, the method comprising:

a first step of supplying an aeration air into the sand blow chamber by aeration air supply means in a state where the blow head and the core box communicate with each other while the blow head is located under the core box, so as to float and fluidize the core sand within the sand blow chamber;

a second step of supplying a compressed air into the sand storage chamber by compressed air supply means according to an instruction from a control unit when a pressure within the sand blow chamber reaches a first pressure, so as to fill the cavity of the core box with the floated and fluidized core sand from within the sand blow chamber after the first step;

a third step of determining after the second step by the control unit according to pressures within the sand blow chamber and sand storage chamber whether or not the filling of the cavity with the core sand is completed and stopping respective operations of the aeration air supply means and compressed air supply means according to an instruction from the control unit when the filling is completed; and a fourth step of evacuating the compressed air from within the sand blow chamber after the third step.

2. The core sand filling method according to claim 1, wherein the first pressure is 0.01 MPa to 0.1 MPa.

3. The core sand filling method according to claim 1, wherein, in the third step, the control unit determines whether each of the respective pressures within the sand blow chamber and sand storage chamber reaches a second pressure or not.

4. The core sand filling method according to claim 3, wherein, in the third step, the control unit determines whether a first condition that each of the respective pressures within the sand blow chamber and sand storage chamber is the second pressure or higher and a second condition that a differential pressure between the pressure within the sand storage chamber and the pressure within the sand blow chamber is a third pressure or lower are satisfied or not.

5. The core sand filling method according to claim 4, wherein the third pressure is 0.002 MPa to 0.015 MPa.

6. The core sand filling method according to claim 4, wherein the third step keeps the aeration air supply means and compressed air supply means operating for a predetermined first time period after both of the first and second conditions are satisfied and then stops the respective operations of the aeration air supply means and compressed air supply means.

7. The core sand filling method according to claim 6, wherein the first time period is 0.3 sec to 1 sec.

8. The core sand filling method according to claim 3, wherein the second pressure is set to 75% to 80% of the pressure of the compressed air supplied from the compressed air supply means while being higher than the first pressure.

9. The core sand filling method according to claim 4, wherein the control unit evaluates whether the second condition is satisfied or not according to an average value of the differential pressure within a predetermined second time period.

10. The core sand filling method according to claim 9, wherein the second time period is 0.05 sec to 0.1 sec.

11. A core sand filling method in a core molding machine using an under-blow type core sand filling device for filling a core box with core sand blown from thereunder;

the core sand filling device comprising:

the core box having a cavity to be filled with the core sand;

a blow head having a sand blow chamber for blowing the core sand into the cavity and a sand storage chamber storing the core sand to be supplied to the sand blow chamber and communicating with the sand blow chamber;

aeration air supply means for supplying the sand blow chamber with an aeration air for floating and fluidizing the core sand within the sand blow chamber;

compressed air supply means for supplying the sand storage chamber with a compressed air;

an exhaust valve for evacuating the compressed air remaining within the sand blow chamber;

a first pressure sensor for measuring a pressure Pf within the sand blow chamber;

a second pressure sensor for measuring a pressure Pc within the sand storage chamber; and a control unit for controlling respective operations of the aeration air supply means, compressed air supply means, and exhaust valve according to signals from the first and second pressure sensors;

the core sand filling method comprising:

a first step of supplying an aeration air into the sand blow chamber by the aeration air supply means in a state where the blow head and the core box communicate with each other while the blow head is located under the core box, so as to float and fluidize the core sand within the sand blow chamber;

a second step of determining after the first step by the control unit whether the pressure Pf of the sand blow chamber measured by the first pressure sensor reaches a first pressure P1 or not and, when the pressure Pf reaches the first pressure P1, supplying the compressed air into the sand storage chamber by the compressed air supply means according to an instruction from the control unit, so as to fill the cavity of the core box with the floated and fluidized core sand from within the sand blow chamber;

a third step of determining after the second step by the control unit whether a first condition that each of the pressure Pf within the sand blow chamber and the pressure Pc within the sand storage chamber is at least a second pressure P2 higher than the first pressure P1 and a second condition that a differential pressure $\Delta P = Pc - Pf$ between the pressure Pc within the sand storage chamber and the pressure Pf within the sand blow chamber is a third pressure P3 or lower are satisfied or not and, when both the first and second conditions are satisfied, stopping the respective operations of the aeration air supply means and compressed air supply means according to an instruction from the control unit; and a fourth step of instructing the exhaust valve to open by the control unit after the third step, so as to evacuate the compressed air from within the sand blow chamber.

12. The core sand filling method according to claim 11, wherein the first pressure P1 is 0.01 MPa to 0.1 MPa.

13. The core sand filling method according to claim 11, wherein the second pressure P2 is set to 75% to 80% of the pressure of the compressed air supplied from the compressed air supply means.

14. The core sand filling method according to claim 11, wherein the third pressure is 0.002 MPa to 0.015 MPa.

15. The core sand filling method according to claim 11, wherein the third step keeps the aeration air supply means and compressed air supply means operating for a predetermined time period T1 after both of the first and second conditions are satisfied and then stops the respective operations of the aeration air supply means and compressed air supply means.

16. The core sand filling method according to claim 15, wherein the predetermined time period T1 is 0.3 sec to 1 sec.

17. The core sand filling method according to claim 11, wherein the control unit determines whether each of the first to fourth steps is completed in a predetermined time period T3 after starting the first step and, when the predetermined time period T3 has elapsed before any of the first to fourth steps is completed, stops operating the core sand filling device.

18. A core sand filling method in a core molding machine using an under-blow type core sand filling device for filling a core box with core sand blown from thereunder;

the core sand filling device comprising:

the core box having a cavity to be filled with the core sand;

a blow head having a sand blow chamber for blowing the core sand into the cavity and a sand storage chamber storing the core sand to be supplied to the sand blow chamber and communicating with the sand blow chamber;

aeration air supply means for supplying the sand blow chamber with an aeration air for floating and fluidizing the core sand within the sand blow chamber;

compressed air supply means for supplying the sand storage chamber with a compressed air;

an exhaust valve for evacuating the compressed air remaining within the sand blow chamber;

a first pressure sensor for measuring a pressure Pf within the sand blow chamber;

a second pressure sensor for measuring a pressure Pc within the sand storage chamber; and a control unit for controlling respective operations of the aeration air supply means, compressed air supply means, and exhaust valve according to signals from the first and second pressure sensors;

the core sand filling method comprising:

a first step of supplying an aeration air into the sand blow chamber by the aeration air supply means in a state where the blow head and the core box communicate with each other while the blow head is located under the core box, so as to float and fluidize the core sand within the sand blow chamber;

a second step of determining after the first step by the control unit whether a predetermined time period indicating that the pressure Pf within the sand blow chamber measured by the first pressure sensor reaches a first pressure P1 has passed or not and, when the predetermined time period has passed, supplying the compressed air into the sand storage chamber by the compressed air supply means according to an instruction from the control unit, so as to fill the cavity of the core box with the floated and fluidized core sand from within the sand blow chamber;

a third step of determining after the second step by the control unit whether a first condition that each of the pressure Pf within the sand blow chamber and the pressure Pc within the sand storage chamber is at least a second pressure P2 higher than the first pressure P1 and a second condition that a differential pressure $\Delta P = Pc - Pf$ between the pressure Pc within the sand storage chamber and the pressure Pf within the sand blow chamber is a third pressure P3 or lower are satisfied or not and, when both the first and second conditions are satisfied, stopping the respective operations of the aeration air supply means and compressed air supply means according to an instruction from the control unit; and a fourth step of instructing the exhaust valve to open by the control unit after the third step, so as to evacuate the compressed air from within the sand blow chamber.

* * * * *